US008204246B2

(12) United States Patent
Marton

(10) Patent No.: US 8,204,246 B2
(45) Date of Patent: Jun. 19, 2012

(54) SOUND TRANSDUCER

(75) Inventor: Ruben Marton, San Vendemiano (IT)

(73) Assignee: Swing S.R.L., San Vendemiano (IT)

( * ) Notice: Subject to any disclaimer, the term of this patent is extended or adjusted under 35 U.S.C. 154(b) by 439 days.

(21) Appl. No.: 12/450,875

(22) PCT Filed: Apr. 17, 2008

(86) PCT No.: PCT/EP2008/054674

§ 371 (c)(1),
(2), (4) Date: Oct. 16, 2009

(87) PCT Pub. No.: WO2008/128966

PCT Pub. Date: Oct. 30, 2008

(65) Prior Publication Data

US 2010/0111323 A1 May 6, 2010

(30) Foreign Application Priority Data

Apr. 20, 2007 (IT) ..... TV2007A0070

(51) Int. Cl.
*H04R 1/02* (2006.01)

(52) U.S. Cl. ..... 381/91; 381/94.2

(58) Field of Classification Search ..... 381/91, 381/92, 355, 369, 409, 410, 174, 322, 324
See application file for complete search history.

(56) References Cited

U.S. PATENT DOCUMENTS 5,031,216 A 7/1991 Goerike et al.
2007/0253574 A1* 11/2007 Soulodre ..... 381/94.2

FOREIGN PATENT DOCUMENTS

EP 0 637 188 A 2/1995
JP 51 050518 A 5/1976

* cited by examiner

*Primary Examiner* — Davetta W Goins
*Assistant Examiner* — Phan Le
(74) *Attorney, Agent, or Firm* — Modiano & Associati; Albert Josif; Daniel O'Byrne

(57) ABSTRACT

A sound transducer, comprising at least one acoustically neutral body with which it is possible to associate two sound conveyance elements which are shaped approximately like a stylized funnel so as to each form an auricle, which protrudes outside the acoustically neutral body and is blended with a duct with which a three-pole microphone cartridge is associated, the cartridge being arranged so that its front end, adapted to acquire the sound, is proximate to the inlet of the duct. The two cold poles of the microphone cartridges are mutually inverted, so that the cold pole of one of the microphone cartridges and the hot pole and the ground of the other of the microphone cartridges are or can be connected to a same connector or socket which is or can be associated with an amplifying and/or recording and/or processing device.

30 Claims, 6 Drawing Sheets

SOUND TRANSDUCER

BACKGROUND OF THE INVENTION

A system for sound recording and playback is known which is termed "stereophonic system" and consists in acquiring a sound by means of two or more microphones, arranged in suitable positions with respect to the sound source, which convert the sound into a plurality of electrical signals, which are then sent to a suitable amplifying and/or recording device, which is adapted to amplify and record and/or process appropriately the signals, thus producing two additional distinct signals which can be sent respectively to two distinct speakers; by positioning the speakers appropriately, it is possible to obtain the sensation of a sound which partially reproduces the three-dimensionality of the real sound.

However, this known type of recording system has drawbacks: in fact, the played back sound is not received in a fully three-dimensional manner, and at best it is possible to obtain a sensation of right or left displacement of the sound, whose correspondence to the real sound depends on the mutual position of the speakers and of the listener.

This known type of sound recording and playback system is therefore inadequate to play back realistically the effect of a sound source which moves, for example, around and/or above the listener.

Sound recording and playback systems are also known which are referenced by the DOLBY SURROUND trademark and provide for the editing, on the part of a sound engineer, of prerecorded audio signals which are then divided, with the aid of an appropriately provided electronic device, such as for example a mixer and/or a computer, into a plurality of multiple channels (typically five or seven, plus an additional channel for the lower frequencies), which are intended to be sent to separate speakers arranged appropriately, typically proximate to the corners of the room where they are used and in front of the listener.

This known type of sound recording and playback system also allows to reproduce the effect of a sound source which moves around the user, with the limitation that this movement always occurs on a horizontal plane.

Therefore, even this known type of sound recording and playback system has drawbacks: in addition to not allowing to transmit to the listener the sensation of a sound source that moves above him, in order to obtain the sensation of the movement of the sound source around the listener it is necessary to have at least five speakers, and therefore this sensation cannot be obtained with listening devices of the portable type which use headphones or earpieces.

Moreover, to achieve a good result during sound playback, the room in which the speakers are arranged must have a square or rectangular plan shape, and this limits the possible applications of this known type of system.

Another drawback of this known type of recording and playback system is that it entails high costs, which can be due both to the step for editing the audio track and to the sound playback step; editing the audio track in fact requires the work of specialized personnel and the use of suitable electronic and/or software devices, which are often very expensive, whereas sound playback requires the use of an appropriately provided playback system, equipped with suitable outputs and with a plurality of speakers, whose cost can be high.

In order to try to optimize the recording of a sound, particularly to listen to it with earpieces, playing back as faithfully as possible the perceptions of a listener located in the room where the sound source is located, a recording technique known as binaural is used which employs a support which has the shape and dimensions of a stylized human head and is made of a material which is adapted to reproduce as much as possible the sound absorption of an actual human head.

This support reproduces faithfully in particular the shape of the auricles and of the auditory canals; two high-fidelity microphone cartridges are fixed respectively to the internal end of the auditory canals and therefore pick up sound in a manner which is similar to the manner in which the eardrum of a listener whose head were arranged like the support would perceive it.

This known type of recording technique also has drawbacks, however; first of all, to achieve good results during playback it is necessary to use very high-quality headphones, which are very expensive.

Further, this known type of technique is inadequate in the reproduction of sounds generated by sources arranged in front of the listener, and the perception of the three-dimensionality of sound is further limited.

Moreover, the sound perceived by the listener during playback cannot be traced back to the sound that reaches the microphone cartridges during recording, since such cartridges record the sound as it would reach the eardrums, while the sound source for the listener is constituted by the earpieces, which are arranged at the auricle of the listener, in contact with the outlet of the auditory canals.

SUMMARY OF THE INVENTION

The aim of the present invention is to solve the above mentioned problems, eliminating the drawbacks of the cited background art, by providing a device which allows to acquire a sound and convert it into an electrical signal, so as to be able to then play it back, transmitting to the listener the sensation of the true three-dimensionality thereof.

Within this aim, an object of the invention is to provide a device which allows to acquire and convert into an electrical signal the sound emitted even by a moving sound source, so as to be able to then play it back, transmitting to the listener the sensation of the actual movement of such source.

Another object is to provide a device which allows to acquire and convert into an electrical signal a sound, so as to be able to then play it back, transmitting to the listener the three-dimensionality of the actual sound even when using simple stereophonic earpieces, even of relatively low quality.

Another object is to provide a device which is structurally simple and has low manufacturing costs.

This aim and these objects, as well as others which will become better apparent hereinafter, are achieved by a sound transducer, characterized in that it comprises at least one acoustically neutral body with which two sound conveyance elements are associatable which are shaped approximately like a stylized funnel so as to form an auricle, which protrudes outside said at least one body and is blended with a duct with which a three-pole microphone cartridge is associated, said cartridge being arranged so that its front end, adapted to acquire the sound, is proximate to the inlet of said duct, the two cold poles of said microphone cartridges being mutually inverted, so that the cold pole of one of said microphone cartridges and the hot pole and the ground of the other of said microphone cartridges are or can be connected to a same connector or socket which is or can be associated with a suitable amplifying and/or recording and/or processing device.

BRIEF DESCRIPTION OF THE DRAWINGS

Further characteristics and advantages of the invention will become better apparent from the following detailed description of a particular but not exclusive embodiment thereof, illustrated by way of non-limiting example in the accompanying drawings, wherein.

DESCRIPTION OF THE PREFERRED EMBODIMENTS

Figure 1:
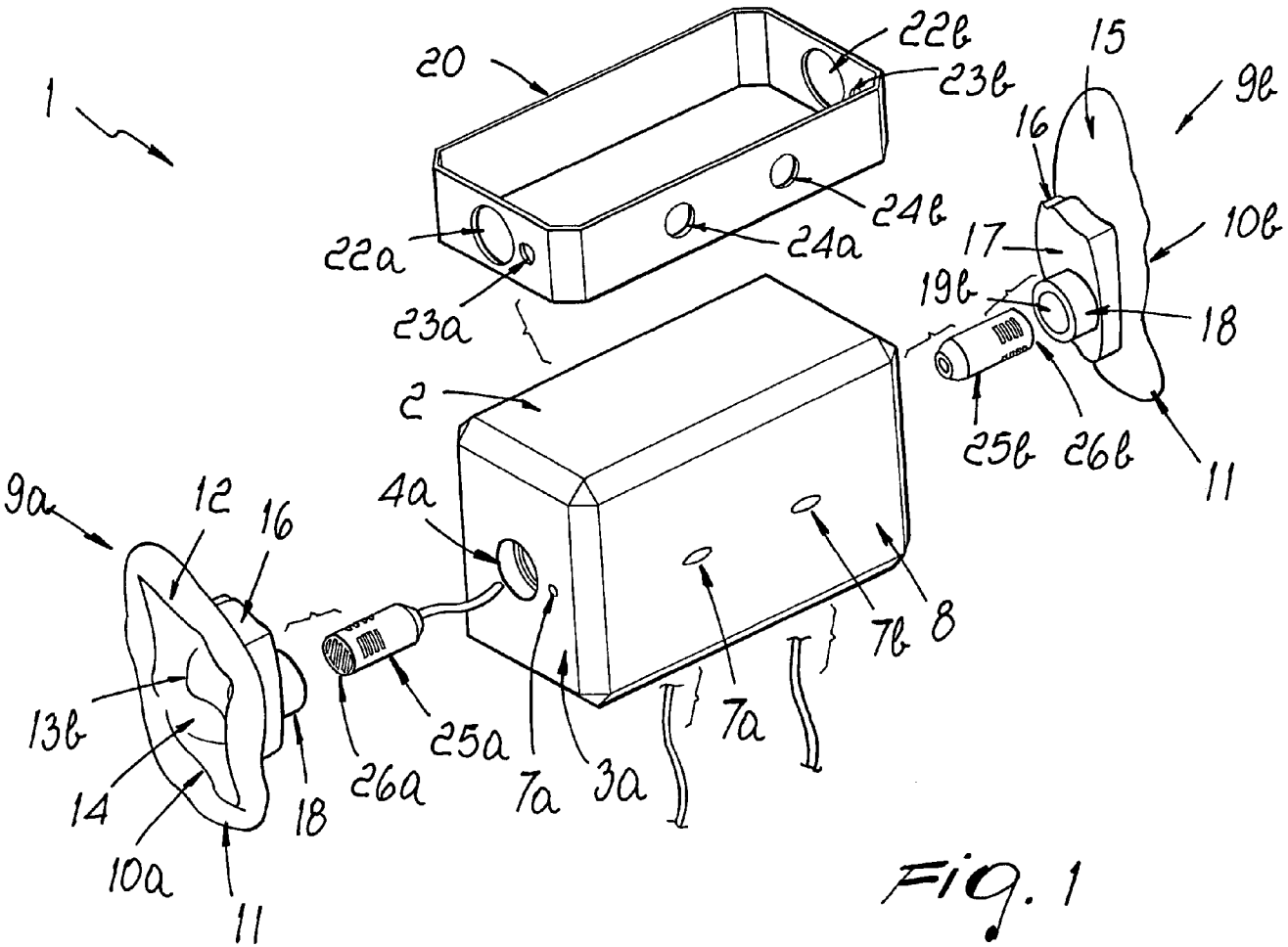
FIG. 1 is an exploded perspective view of a device according to the invention.
Figure 3:
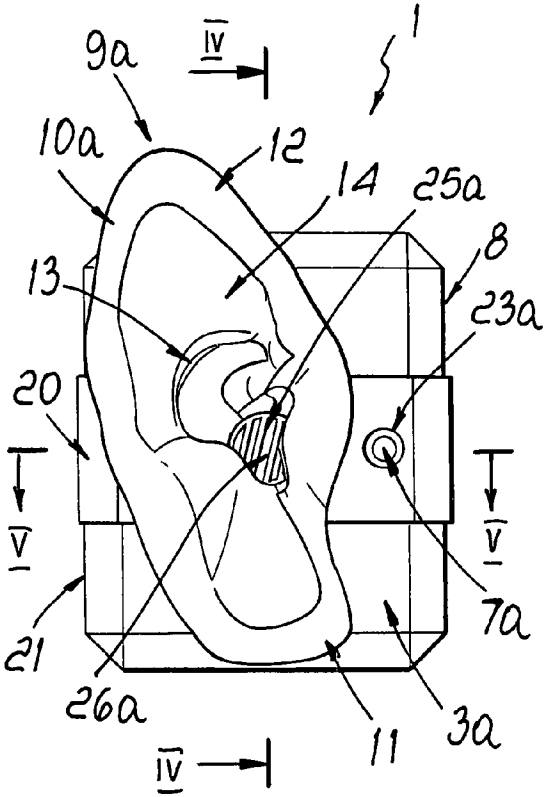
FIG. 3 is a side view of the device of FIG. 1.
Figure 2:
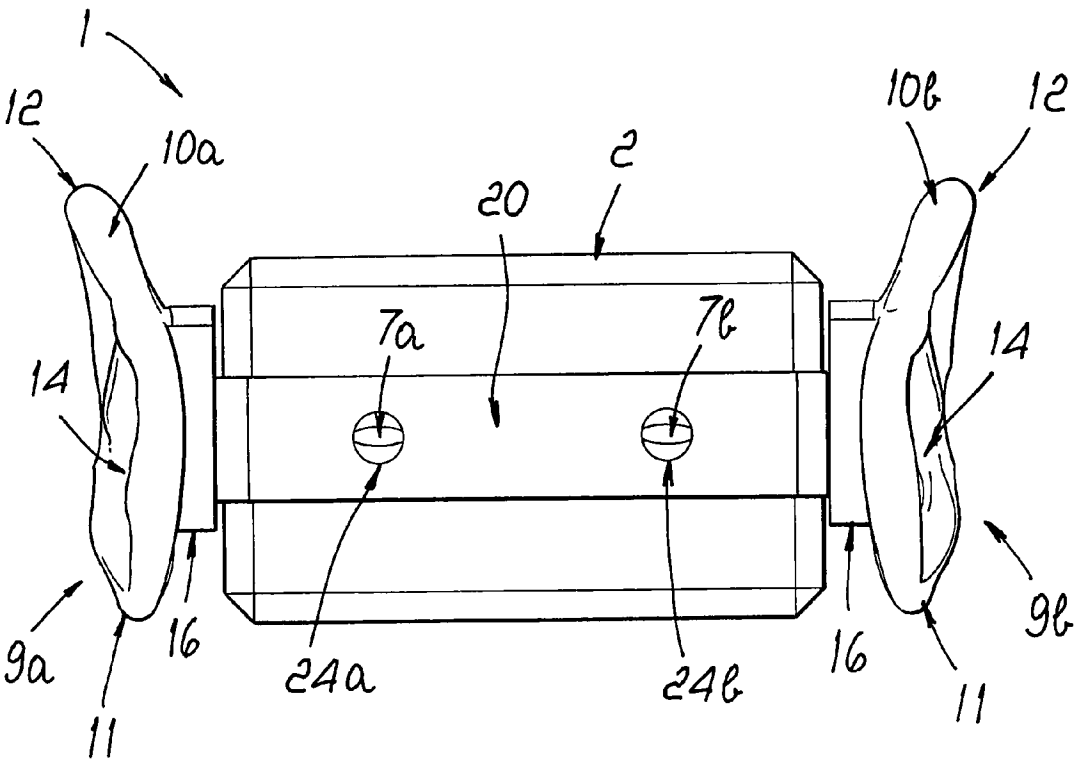
FIG. 2 is a front view of the device of FIG. 1.
Figure 4:
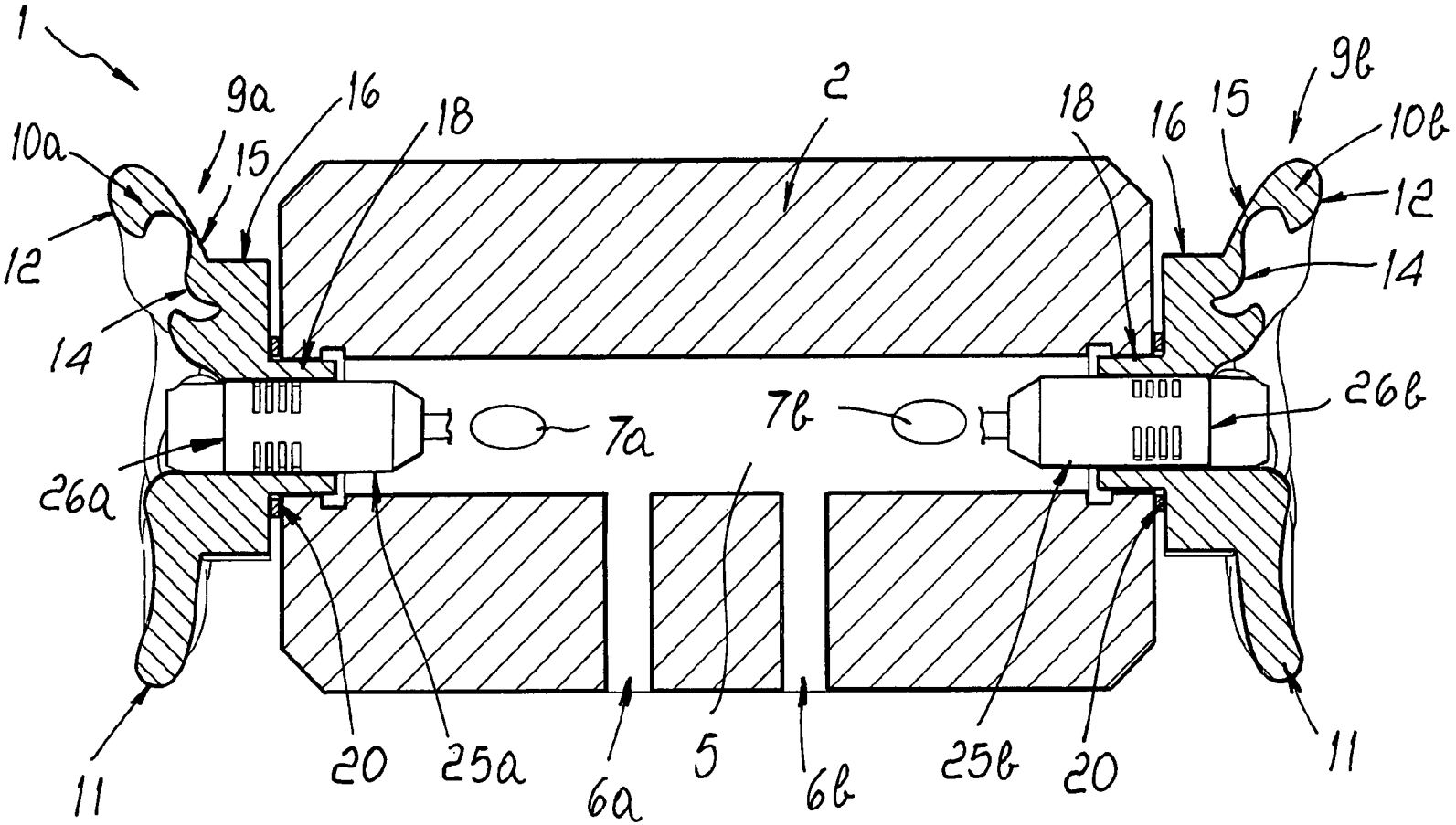
FIG. 4 is a sectional view, taken along the line IV-IV of FIG. 3.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

With reference to the figures, the reference numeral 1 designates a sound transducer which comprises at least one acoustically neutral body 2, which is made of acoustically neutral material such as for example an open-cell polyurethane sponge rubber.

Advantageously but not necessarily, the acoustically neutral body 2 has a polyhedral shape, which is approximately parallelepipedal with suitably beveled edges, and conveniently its width is approximately equal to the average width of a human head proximate to the ear region.

The acoustically neutral body 2 might be constituted by two mirror-symmetrical halves.

Two preferably but not necessarily approximately cylindrical seats 4*a* and 4*b* are provided at the two sides of the acoustically neutral body 2, preferably along a same longitudinal axis, and therefore, in the example shown in the accompanying figures, starting from two first mutually parallel lateral surfaces, designated by the reference numerals 3*a* and 3*b*, of the acoustically neutral body 2.

Advantageously but not necessarily, as in the case of the embodiment shown in the accompanying figures, the two seats 4*a* and 4*b* are mutually connected, being formed by a single first channel 5 which passes axially through the acoustically neutral body 2.

Advantageously, the acoustically neutral body 2 is crossed by one or more additional through channels 6*a*, 6*b*, which are formed preferably but not necessarily along an axis which is perpendicular to the first channel 5 and enter the first channel 5, preferably proximate to the central region thereof.

The acoustically neutral body 2 has means which are adapted to guide toward its lateral regions a sound which is frontally incident to it; advantageously, such means are constituted by two third channels 7*a* and 7*b*, which are formed in the acoustically neutral body 2 starting from a second front surface 8 thereof and lie transversely to the acoustically neutral body 2, leading out respectively on the first surfaces 3*a* and 3*b*, advantageously proximate to the seats 4*a* and 4*b*.

Advantageously, it is possible to associate with the two seats 4*a* and 4*b* provided at the two sides of the acoustically neutral body 2 respectively two sound conveyance elements, designated by the reference numerals 9*a* and 9*b*, which are conveniently arranged in a mutually mirror-symmetrical fashion.

Conveniently, the two sound conveyance elements 9*a* and 9*b* are approximately shaped like a stylized funnel, so as to form an auricle 10*a*, 10*b* which during use protrudes outside the acoustically neutral body 2.

Advantageously but not necessarily, the two sound conveyance elements 9*a* and 9*b* are made of two-part silicone, for example the one known under the trademark RHODORSIL, of the type RTV4028 A+B, at 50%.

In the embodiment shown in the accompanying figures, the sound conveyance elements 9*a* and 9*b* advantageously are shaped approximately like a stylized outer ear; auricles 4 therefore have, advantageously but not necessarily, a shape which can be obtained approximately starting from the shape of an auricle of a human outer ear, optionally increasing its dimensions appropriately, for example increasing the length of the lobe 11 and extending upward the region of the helix 12 and of the antihelix 13.

In the embodiment shown in the accompanying figures, the lobe 11 of the auricles 10*a* and 10*b* is preferably approximately as long as one third of the longitudinal extension of the respective auricle 10*a* and 10*b*, and the helix 12 and the antihelix 13 have an appropriately teardrop-shaped configuration.

Figure 8:
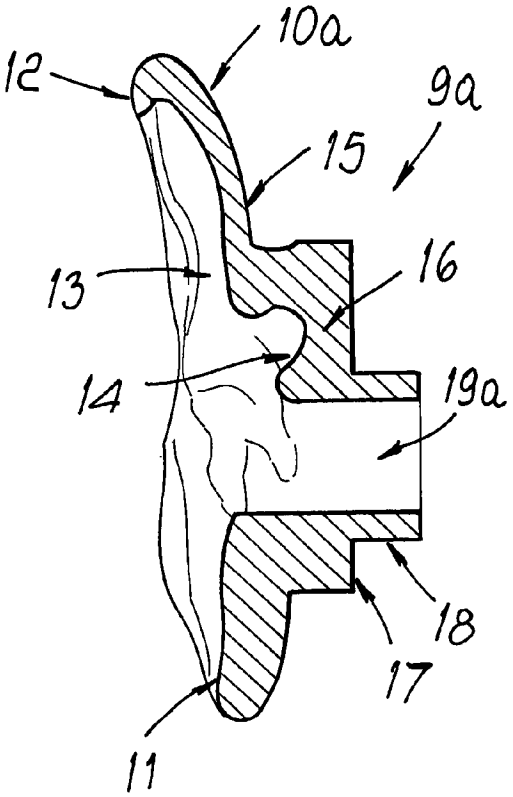
FIG. 8 is a sectional view, taken along the line VIII-VIII of FIG. 7.
Figure 7:
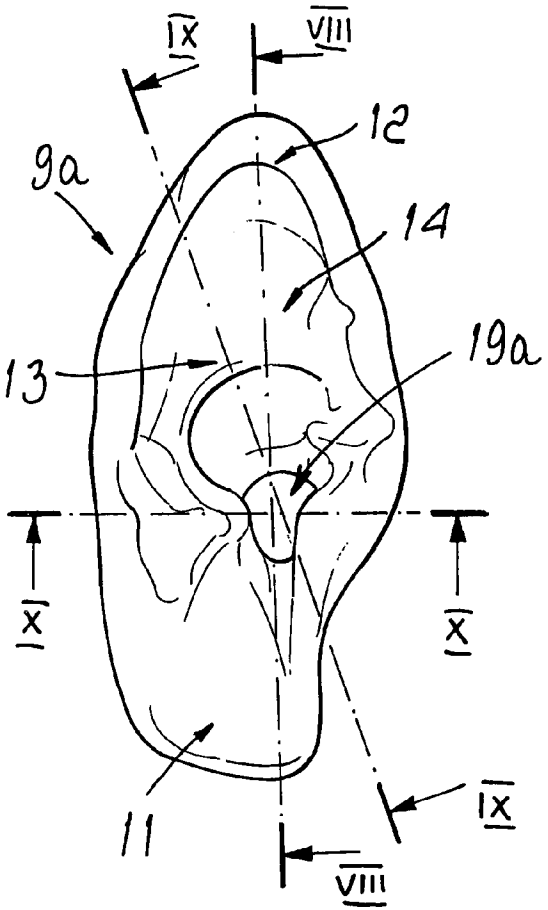
FIG. 7 is a side view of a sound conveyance element of the device according to the preceding figures.
Figure 9:
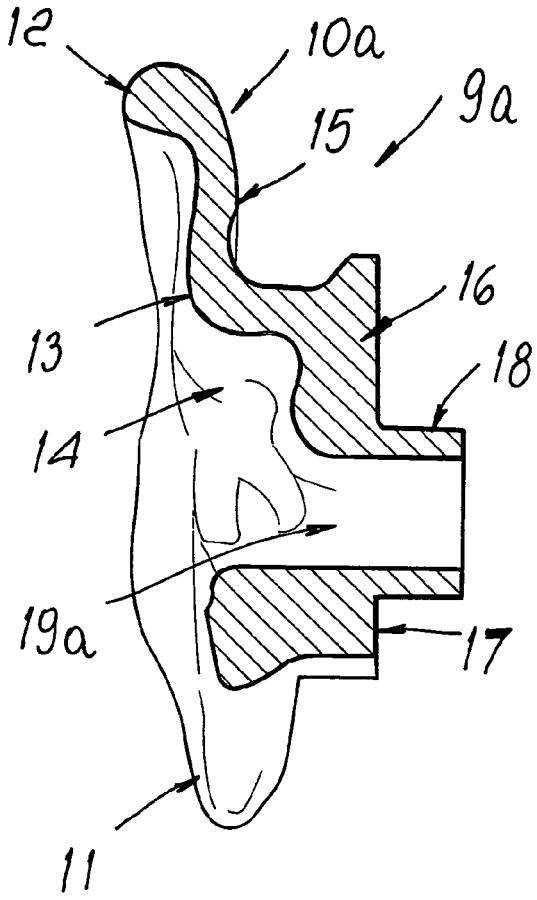
FIG. 9 is a sectional view, taken along the line IX-IX of FIG. 7.
Figure 10:
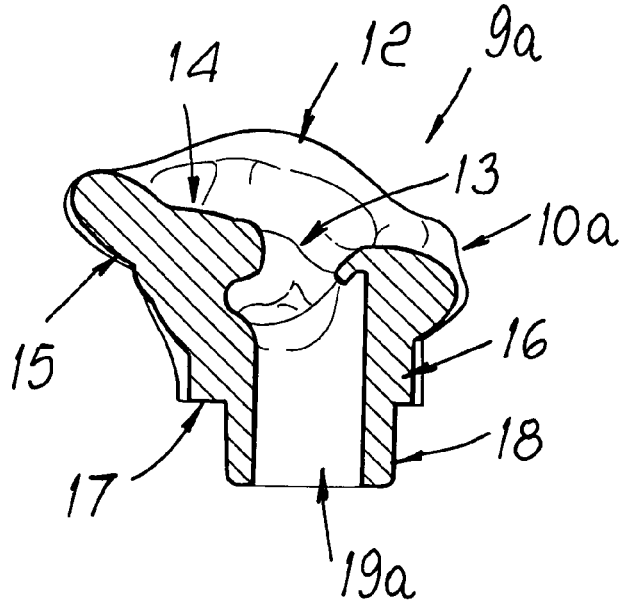
FIG. 10 is a sectional view, taken along the line X-X of FIG. 7.

Advantageously, as can be seen in particular from FIGS. 8, 9 and 10, an internal wall 14 of the auricles 10*a*, 10*b* which during use is directed away from the acoustically neutral body 2 is constituted by a plurality of contiguous concave and convex surfaces, which are adapted to convey the sound from the peripheral region of the auricles 10*a* and 10*b* to their bottom.

The shape of the internal wall 14 of the auricles 10*a* and 10*b* further contributes to enrich the sound with harmonics and resonance microreflections, thanks to a series of reflections and diffractions of such sound caused by striking said concave and convex surfaces; said harmonics and resonance microreflections allow to acquire a sound which is complete with spatial references, so that the brain of the listener, when listening, can unconsciously reconstruct the sensation of the true three-dimensionality of the sound.

The elongated shape of the auricles 10*a* and 10*b* further allows to also convey high frequencies and ultrasound which cannot be detected by the human ear.

A footing 16 protrudes from the outer wall 15 of the auricles 10*a* and 10*b* and during use is directed toward the acoustically neutral body 2; said footing has a third flat surface 17 which during use is directed toward the acoustically neutral body 2 and from which a tubular element 18 protrudes approximately at right angles and is shaped approximately complementarily, in a transverse cross-section, with respect to the seats 4*a*, 4*b*, so that it can be inserted and fixed, preferably by pushing, in one of them; in the example shown in the accompanying figures, the tubular element 18 is conveniently cylindrical.

Advantageously, starting from the bottom of the auricles 10*a* and 10*b* there are respectively two through ducts 19*a* and 19*b*, which are preferably cylindrical and pass through the footing 16 and axially through the tubular element 18 of the respective sound conveyance element 9*a*, 9*b*.

In the analogy between the shape of the sound conveyance elements 9*a* and 9*b* and the human outer ear, the ducts 19*a* and 19*b* approximately correspond to the acoustic meatus.

Advantageously but not necessarily, the two sound conveyance elements 9*a* and 9*b* are interconnected by suitable connecting means which, in the embodiment shown in the accompanying figures, are constituted by a ring 20, which is preferably made of a material which is not sound-absorbing, such as for example an aluminum alloy known by the trademark AVIONAL or ANTICORODAL.

Advantageously, the ring 20 is shaped so that it can be arranged so as to surround part of the first lateral surfaces 3*a* and 3*b*, of the second front surface 8 and of a fourth rear surface 21 of the acoustically neutral body 2.

Advantageously, in the ring 20 there are two first holes 22*a*, 22*b*, which are provided in such a position that they face, during use, the seats 4*a* and 4*b* provided in the acoustically neutral body 2, and have such dimensions and shapes as to allow access in the contiguous seats 4*a* and 4*b* of the tubular elements 18 of the sound conveyance elements 9*a*, 9*b*.

Advantageously, two second holes 23*a*, 23*b* are provided in the ring 20, in such a position as to face, during use, the outlets of the second channels 7*a* and 7*b* provided on the first surfaces 3*a* and 3*b* of the acoustically neutral body 2, and the second holes advantageously have dimensions which are equal to, or greater than, those of the outlets.

Advantageously, two third holes 24*a*, 24*b* are provided in the ring 20, in such a position as to face during use the inlets of the second channels 7*a* and 7*b* provided on the second surface 8 of the acoustically neutral body 2; the third holes advantageously have dimensions which are equal to, or greater than, those of said inlets.

Advantageously, the ring 20 is interposed, during use, between the third surface 17 of the footings 16 of the sound conveyance elements 9*a* and 9*b* and the first lateral surfaces 3*a*, 3*b* of the acoustically neutral body 2.

Advantageously, two microphone cartridges 25*a*, 25*b* are arranged respectively within the ducts 19*a* and 19*b* of the sound conveyance elements 9*a* and 9*b* and are arranged with their front end, designated by the reference numerals 26*a* and 26*b* and adapted to acquire sound, approximately at the inlet of the respective ducts 19*a* and 19*b* provided on the bottom of the auricles 10*a* and 10*b*.

The front end 26*a* and 26*b* is therefore positioned either adjacent to the inlet of the ducts 19*a*, 19*b* or also partially shifted toward the inside of the auricle 10*a*, 10*b*.

Advantageously, the microphone cartridges 25*a* and 25*b* have a polar pattern of the cardioid type.

The microphone cartridges 25*a* and 25*b* are of the three-pole type, and are supplied with a power supply of the type known as "phantom"; accordingly, a three-pole cable 27*a*, 27*b* exits from each one of the microphone cartridges 25*a* and 25*b* and each of said cables in turn comprises a first wire 28*a*, 28*b*, also known as "hot pole", a second wire 29*a*, 29*b*, also known as "cold pole", and a third earthing wire 30*a*, 30*b*, also known as "ground".

Advantageously, the three-pole cables 27*a* and 27*b* exit from the acoustically neutral body 2 through the second channels 6*a*, 6*b*, so that they can be connected for example to an amplifier or to a mixer or to a recording device or to a computer, not shown in the accompanying figures, which have suitable power supply means for the microphone cartridges 25*a* and 25*b*.

Figure 6:
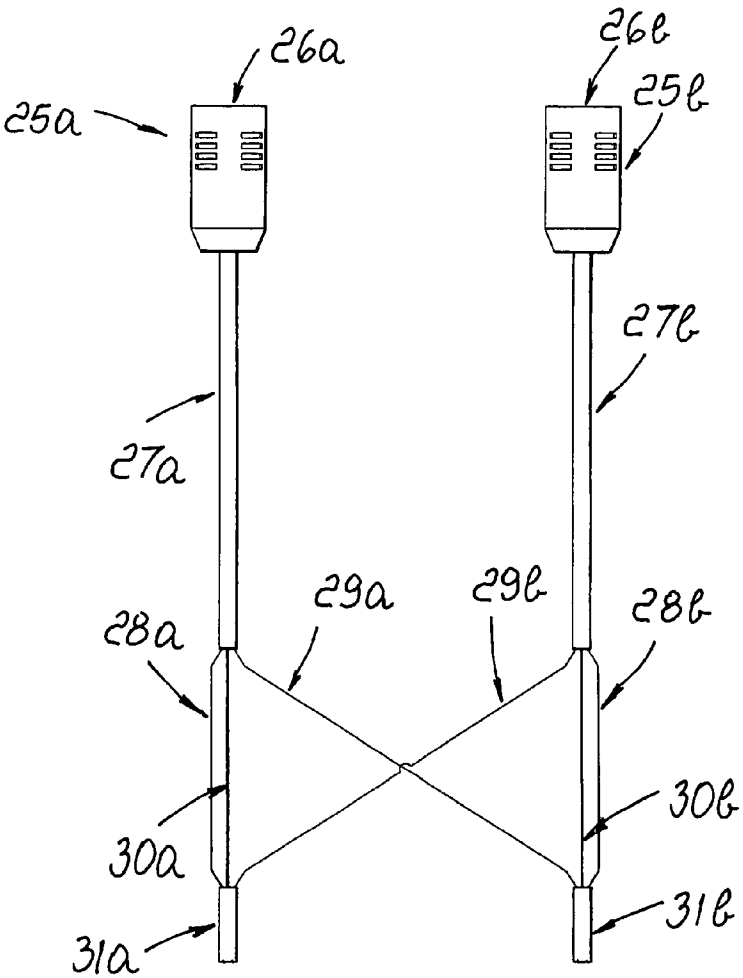
FIG. 6 is a schematic view of the connection between the two microphone cartridges.
Figure 5:
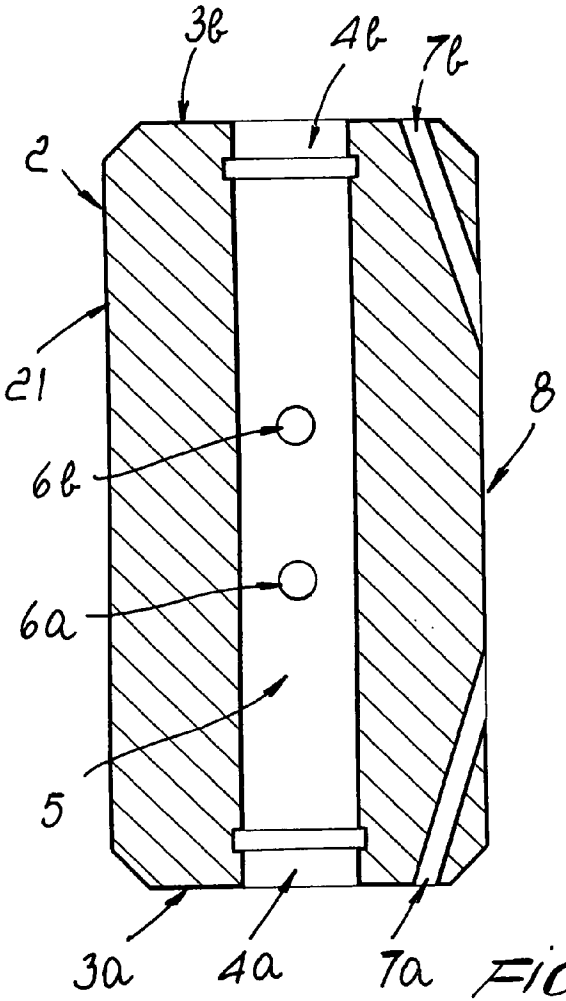
FIG. 5 is a sectional view of the supporting element, taken along the line V-V of FIG. 3.

Advantageously, as shown schematically in FIG. 6, in the device according to the invention the two cold poles 29*a* and 29*b* of the two microphone cartridges 25*a* and 25*b* are mutually inverted.

In other words, the cold pole 29*a* of the microphone cartridge 25*a* is connected to a same connector or socket, designated schematically in FIG. 6 by the reference numeral 31*b*, which is or can be connected to a suitable acquisition and/or recording and/or amplifying and/or processing device, not shown in the accompanying figures, to which the hot pole 28*b* and the ground 30*b* of the microphone cartridge 25*b* are connected; vice versa, the cold pole 29*b* of the microphone cartridge 25*b* is connected to the same connector or socket 31*a* to which the hot pole 28*a* and the ground 30*a* of the microphone cartridge 25*a* are connected.

Use of the invention is therefore as follows. With reference to the accompanying figures, the three-pole cables 27*a* and 27*b* are connected in the manner described above to two connectors or sockets 31*a*, 31*b*, which are connected for example to an acquisition and/or recording and/or amplifying and/or processing device, not shown in the accompanying figures, such as for example a recorder, a computer, a mixer.

By arranging the device 1 in a chosen position with respect to a sound source, which can also be moving, the sound produced by it strikes the two auricles 10*a* and 10*b* and is thus conveyed by them to the microphone cartridges 25*a* and 25*b*.

A sound that strikes the second front surface 8 of the acoustically neutral body 2 enters the third channels 7*a* and 7*b* and then exits from them at the first lateral surfaces 3*a*, 3*b* of the acoustically neutral body 2, so that it can then be collected by the auricles 10*a* and 10*b* and conveyed to the microphone cartridges 25*a* and 25*b*.

The microphone cartridges 25*a* and 25*b* thus convert the sound conveyed to them by the auricles 10*a* and 10*b* into an electrical signal and, through the three-pole cables 27*a* and 27*b*, transmit the electrical signal to the acquisition and/or recording and/or amplifying and/or processing device, which records and/or plays back and/or allows to process appropriately such signal, so that it can then be played back even with two simple stereophonic earpieces.

The particular structure of the device 1 allows the sound acquired and transmitted to the acquisition and/or recording and/or amplifying and/or processing device to contain all the information capable of producing in the listener, particularly if he/she uses stereophonic earpieces, the exact sensation that would be produced by the actual sound source.

It has thus been observed that the invention has achieved the intended aim and objects, a sound transducer having been devised which allows to acquire and convert into an electrical signal a sound, so as to be able to then play it back, transmitting to the listener the sensation of its actual three-dimensionality.

Further, the device according to the invention also allows to acquire a sound produced by a moving source and to convert it into an electrical signal which can then be played back, transmitting to the listener the sensation of the actual motion of the source by means of two simple speakers.

Moreover, the device according to the invention allows to acquire a sound and convert it into an electrical signal, so as to be able to then play it back, transmitting to the listener its actual three-dimensionality, even by using simple stereophonic earpieces, even of low quality.

Further, the production costs of the device according to the invention remain low, since it is provided only by means of components which are easy to manufacture and/or assemble.

The invention is of course susceptible of numerous modifications and variations, all of which are within the scope of the appended claims.

The materials used, as well as the dimensions that constitute individual components of the invention, may of course be more pertinent according to specific requirements.

The various means for performing certain different functions need not certainly coexist only in the illustrated embodiment but can be present per se in many embodiments, including ones that are not illustrated.

The characteristics indicated as advantageous, convenient or the like may also be omitted or be replaced with equivalents.

The disclosures in Italian Patent Application No. TV2007A000070 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

What is claimed is:

1. A sound transducer, comprising at least one acoustically neutral body with which two sound conveyance elements are associatable which are shaped approximately like a stylized funnel so as to form an auricle, which protrudes outside said at least one acoustically neutral body and is blended with a duct with which a three-pole microphone cartridge is associated, said cartridge being arranged so that its front end, adapted to acquire the sound, is proximate to the inlet of said duct, the two cold poles of said microphone cartridges being mutually inverted, so that the cold pole of one of said microphone cartridges and the hot pole and the ground of the other of said microphone cartridges are or can be connected to a same connector or socket which is or can be associated with an amplifying and/or recording and/or processing device.

2. The device according to claim 1, wherein said acoustically neutral body has a polyhedral shape and has a width which is approximately equal to the average width of a human head proximate to the ear region.

3. The device according to claim 1, wherein said acoustically neutral body is constituted by two mutually mirror-symmetrical halves.

4. The device according to claim 1, wherein two seats are formed on two opposite sides of said acoustically neutral body, along a same longitudinal axis of said acoustically neutral body.

5. The device according to claim 4, wherein said acoustically neutral body has an approximately parallelepipedal shape, with bevelled edges, said two seats being formed starting from two first mutually parallel lateral surfaces of said acoustically neutral body.

6. The device according to claim 5, wherein said two seats are connected so as to form a single first channel which passes axially through said acoustically neutral body.

7. The device according to claim 6, wherein said acoustically neutral body is crossed by one or more second additional through channels, which lead into said first channel, proximate to its central region.

8. The device according to claim 4, wherein said acoustically neutral body is provided with means which are adapted to guide toward lateral regions thereof a sound which is frontally incident to it.

9. The device according to claim 8, wherein said means adapted to guide toward the lateral regions of said acoustically neutral body a sound which is frontally incident thereto are constituted by two third channels which are formed in said acoustically neutral body starting from a second front surface thereof and lie transversely to said acoustically neutral body, leading respectively onto said first surfaces of the latter, proximate to said two seats.

10. The device according to claim 1, wherein said acoustically neutral body is made of open-cell polyurethane sponge rubber.

11. The device according to claim 1, wherein said sound conveyance elements can be associated with said body respectively at said two seats.

12. The device according to claim 1, wherein said sound conveyance elements are made of two-part silicone.

13. The device according to claim 1, wherein said sound conveyance elements have approximately the shape of a human outer ear.

14. The device according to claim 13, wherein said auricles have a shape which can be obtained starting approximately from the contour of an auricle of a human outer ear of increased size.

15. The device according to claim 13, wherein said auricles have a shape which can be obtained approximately starting from the contour of a human outer ear by increasing the length of a lobe and extending upward the region of a helix and an antihelix.

16. The device according to claim 15, wherein said lobe of said auricles has a length which is approximately equal to one third of the longitudinal extension of the respective auricle and said helix and antihelix have a teardrop-shaped configuration.

17. The device according to claim 1, wherein the internal wall of said auricles which during use is directed away from said acoustically neutral body is constituted by a plurality of contiguous concave and convex surfaces, which are adapted to convey the sound from the peripheral region of said auricles to their bottom.

18. The device according to claim 17, wherein a footing protrudes from the outer wall of said auricles which during use is directed toward said acoustically neutral body and has a third flat surface which during use is directed toward said acoustically neutral body and from which a tubular element protrudes approximately at right angles, said tubular element being shaped approximately complementarily, in a transverse cross-section, with respect to said two seats, so that it can be inserted and fixed in one of them.

19. The device according to claim 18, wherein said two seats and said tubular element have a circular cross-section.

20. The device according to claim 19, wherein said cylindrical ducts are obtained starting from the bottom of said auricles and pass through said footing and axially through said tubular element.

21. The device according to claim 1, wherein said sound conveyance elements interact with each other by way of connecting means.

22. The device according to claim 21, wherein said connecting means are constituted by a ring which is made of a material which does not absorb sound.

23. The device according to claim 22, wherein said ring is shaped so that it can be arranged so as to wrap around part of said first lateral surfaces of said second front surface and of a fourth rear surface of said acoustically neutral body.

24. The device according to claim 23, wherein two first holes are formed in said ring, in such a position that they face, during use, said two seats of said acoustically neutral body, said holes having a shape and dimensions which allow the insertion of said tubular elements in said two seats.

25. The device according to claim 24, wherein two second holes are formed in said ring, in such a position that they face, during use, the outlets of said second channels, provided on said first surfaces of said acoustically neutral body, said second holes having dimensions which are equal to, or greater than, those of said outlets of said second channels.

26. The device according to claim 25, wherein said ring there are two third holes in such a position that they face, during use, the inlets of said second channels provided in said second surface of said acoustically neutral body, said third holes having dimensions which are equal to, or greater than, those of said inlets of said second channels.

27. The device according to claim 26, wherein said ring is interposed, during use, between said third surface of said footings of said sound conveyance elements and said first lateral surfaces of said acoustically neutral body.

28. The device according to claim 1, wherein said front end of said microphone cartridges is arranged adjacent to said inlet of said ducts or is partially shifted toward the inside of said auricle.

29. The device according to claim 1, wherein said microphone cartridges have a polar pattern of the cardioid type, are supplied with a power supply of the type known as "phantom", and each one has a three-pole cable which exits from it, said cable containing a first wire, which constitutes said "hot pole", a second wire, which constitutes said "cold pole", and a third wire, which constitutes said "ground", characterized in that said three-pole cables exit from said acoustically neutral body through said second channels.

30. A sound transducer, comprising at least one acoustically neutral body with which two sound conveyance elements are associatable which are shaped approximately like an outer ear so as to form a region shaped approximately like an auricle which protrudes outside said at least one acoustically neutral body and with which a three-pole microphone cartridge is associated in the region that approximately corresponds to the acoustic meatus region, said cartridge being arranged so that its front end, adapted to acquire the sound, is proximate to the inlet of said acoustic meatus, the two cold poles of said microphone cartridges being mutually inverted, so that the cold pole of one of said microphone cartridges and the hot pole and the ground of the other of said microphone cartridges are or can be connected to a same connector or socket which is or can be associated with an amplifying and/or recording and/or processing device.

* * * * *